US007381916B2

(12) United States Patent
Wong

(10) Patent No.: US 7,381,916 B2
(45) Date of Patent: Jun. 3, 2008

(54) ROLLING-BALL SWITCH

(75) Inventor: Ping-Tong Wong, Hul zhou Guang Dong (CN)

(73) Assignee: Comax Electronics (Hul Zhou) Co., Ltd., Hui Zhou Guang Dong (CN)

( * ) Notice: Subject to any disclaimer, the term of this patent is extended or adjusted under 35 U.S.C. 154(b) by 133 days.

(21) Appl. No.: 11/413,087

(22) Filed: Apr. 28, 2006

(65) Prior Publication Data

US 2007/0251807 A1 Nov. 1, 2007

(51) Int. Cl.
*H01H 35/02* (2006.01)

(52) U.S. Cl. ..... 200/61.52; 200/61.45 R

(58) Field of Classification Search ..... 200/5 A, 200/61.45 R, 277, 52 A, 61.52
See application file for complete search history.

(56) References Cited

U.S. PATENT DOCUMENTS 3,032,620 A * 5/1962 Suberg ..... 200/432
3,792,210 A * 2/1974 O'Dea et al. ..... 200/61.59
3,955,356 A * 5/1976 LeCocq ..... 368/225
3,971,905 A * 7/1976 Delaage ..... 200/432
4,001,185 A * 1/1977 Mitsui et al. ..... 200/61.45 R
4,027,119 A * 5/1977 Tezuka ..... 200/6 A
4,135,067 A * 1/1979 Bitko ..... 200/61.52
4,149,049 A * 4/1979 Long ..... 200/432
4,751,353 A * 6/1988 Stephens ..... 200/277
4,766,275 A * 8/1988 Hemmann et al. ..... 200/277
5,087,961 A * 2/1992 Long et al. ..... 257/701
5,194,707 A * 3/1993 Wallach ..... 200/61.45 R
5,307,054 A * 4/1994 Concannon et al. ..... 340/690
6,024,629 A * 2/2000 Takekoshi ..... 451/28
6,448,516 B1 * 9/2002 Chiang ..... 200/61.45 R
6,518,523 B1 * 2/2003 Chou ..... 200/61.52
6,559,396 B1 * 5/2003 Chou ..... 200/61.52
6,706,978 B2 * 3/2004 Wagatsuma et al. .. 200/61.45 R

FOREIGN PATENT DOCUMENTS

TW 496312 7/2002
TW M256575 2/2005
WO WO 03032620 A2 * 4/2003

* cited by examiner

*Primary Examiner*—Michael A Friedhofer
*Assistant Examiner*—Lisa N Klaus

(57) ABSTRACT

A rolling-ball switch includes a casing having two racks. A chamber is defined after a round stage and a sealing groove are fit in the casing. The chamber includes a first contact plate, a second contact plate and a third contact plate on two ends faces thereof and forming a switch with a conductive ball. The third contact plate is connected integrally with a common terminal and an open groove is defined between the first contact plate and the second contact plate. The first contact plate and the second contact plate are connected to a first terminal and a second terminal outside a casing. The switch is rotated to turn off power when an electrical device is rotated more than a predetermined angle. The predetermined angle can be adjusted by setting an angle between the open groove and a vertical line.

9 Claims, 5 Drawing Sheets

ROLLING-BALL SWITCH

BACKGROUND OF THE INVENTION

1. Field of the Invention

The present invention relates to a switch, especially to a tilt switch for electrical device triggered by weak current.

2. Description of Prior Art

As the progress of technology, the performance and security request of electrical device are demanding. For example, the electrical device such as electrical fan and iron are demanded with fireproof. Taiwan patent No. M256575 discloses a tilt switch for electrical device. The tilt switch is arranged in the electronic device and is electrically connected to power source of the electrical device. The tilt switch cuts off power to the electrical device when the electrical device is tilted. However, the conventional tilt switch for the electrical device generally has bulky sizes and high cost. Moreover, the sensitive is poor and wrong operation is liable to happen.

Moreover, Taiwan patent No. 496312 discloses a power-off tilt switch for motor cycle. However, the power-off tilt switch has bulky size and cannot be arranged within electrical device with limited size. This power-off tilt switch is used for motorcycle and cuts off power from the motorcycle when the motorcycle is tilted.

SUMMARY OF THE INVENTION

The present invention is to provide a compact tilt switch for electrical device, where the tilt switch has low cost and fast response.

Accordingly, the present invention provides a rolling-ball switch, which includes a casing having two racks. A chamber is defined after a round stage and a sealing groove are fit in the casing. The chamber includes a first contact plate; a second contact plate and a third contact plate on two ends faces thereof and forming a switch with a conductive ball. The third contact plate is connected integrally with a common terminal and an open groove is defined between the first contact plate and the second contact plate. The first contact plate and the second contact plate are connected to a first terminal and a second terminal outside a casing. A dent is defined at each of the side faces, where the separation between the two dents is larger than the diameter of the conductive ball.

BRIEF DESCRIPTION OF DRAWING

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

Figure 1:
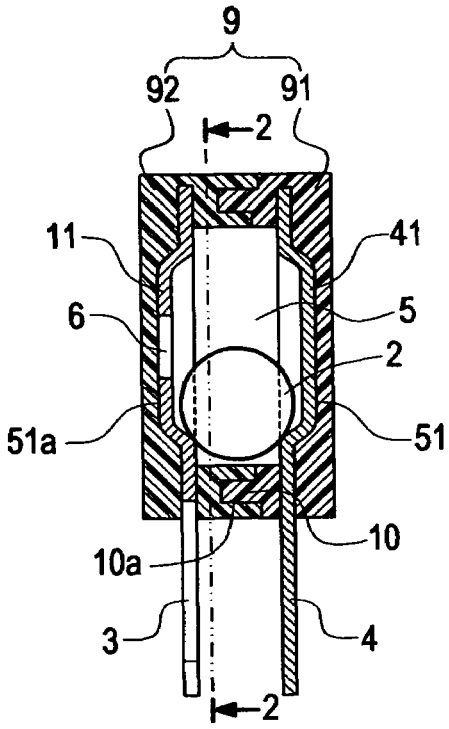
FIG. 1 shows a first sectional view of the switch of the present invention in erected state.

With reference to FIGS. 1 to 4, the present invention discloses a rolling-ball switch. The rolling-ball switch includes a casing 9 composed of two racks 91 and 92. The rack 91 includes a round stage 10 and coupling holes 12 around the round stage 10. The rack 92 includes a sealing tank 10*a* fit with the round stage 10 and a plurality of cooping posts 12*a* around the sealing tank 10*a*. When the rack 91 is coupled with the rack 92, the coupling post 12*a* is fit into the coupling hole 12 and the round stage 10 is fit into the sealing tank 10*a*.

After the racks 91 and 92 are assembled into the casing 9, an annulus chamber 5 for guiding rail is defined between the round stage 10 and the sealing tank 10*a*. The annulus chamber 5 is provided with a first, a second and a third contact plate 11, 31 and 41 on two end faces thereof and a conductive ball 2. The first, the second and the third contact plates 11, 31 and 41 are electrically connected to contacts outside the annulus chamber 5. When the rolling-ball switch is in erected position, the conductive ball 2 is in contact with all of the first, the second and the third contact plates 11, 31 and 41 in the annulus chamber 5.

Figure 2:
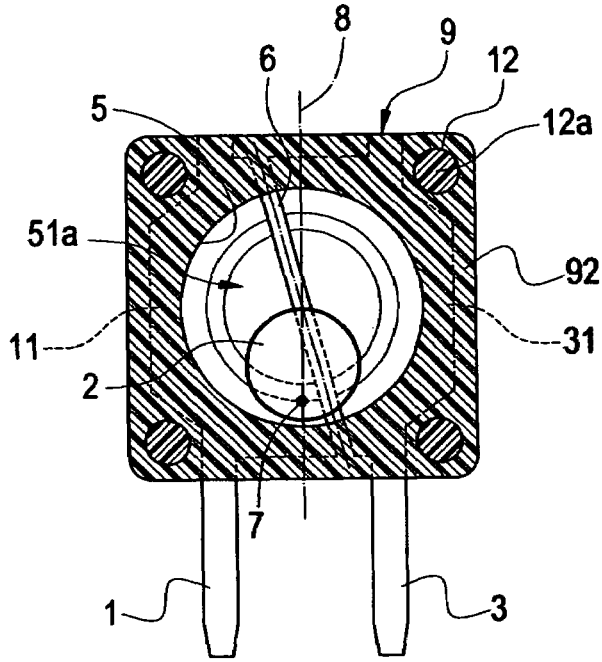
FIG. 2 shows a second sectional view of the switch of the present invention in erected state.
Figure 3:
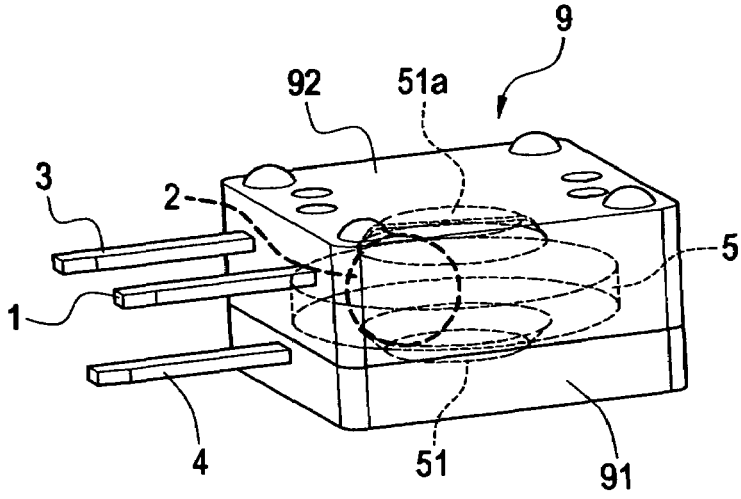
FIG. 3 shows a perspective view of the switch of the present invention.
Figure 4:
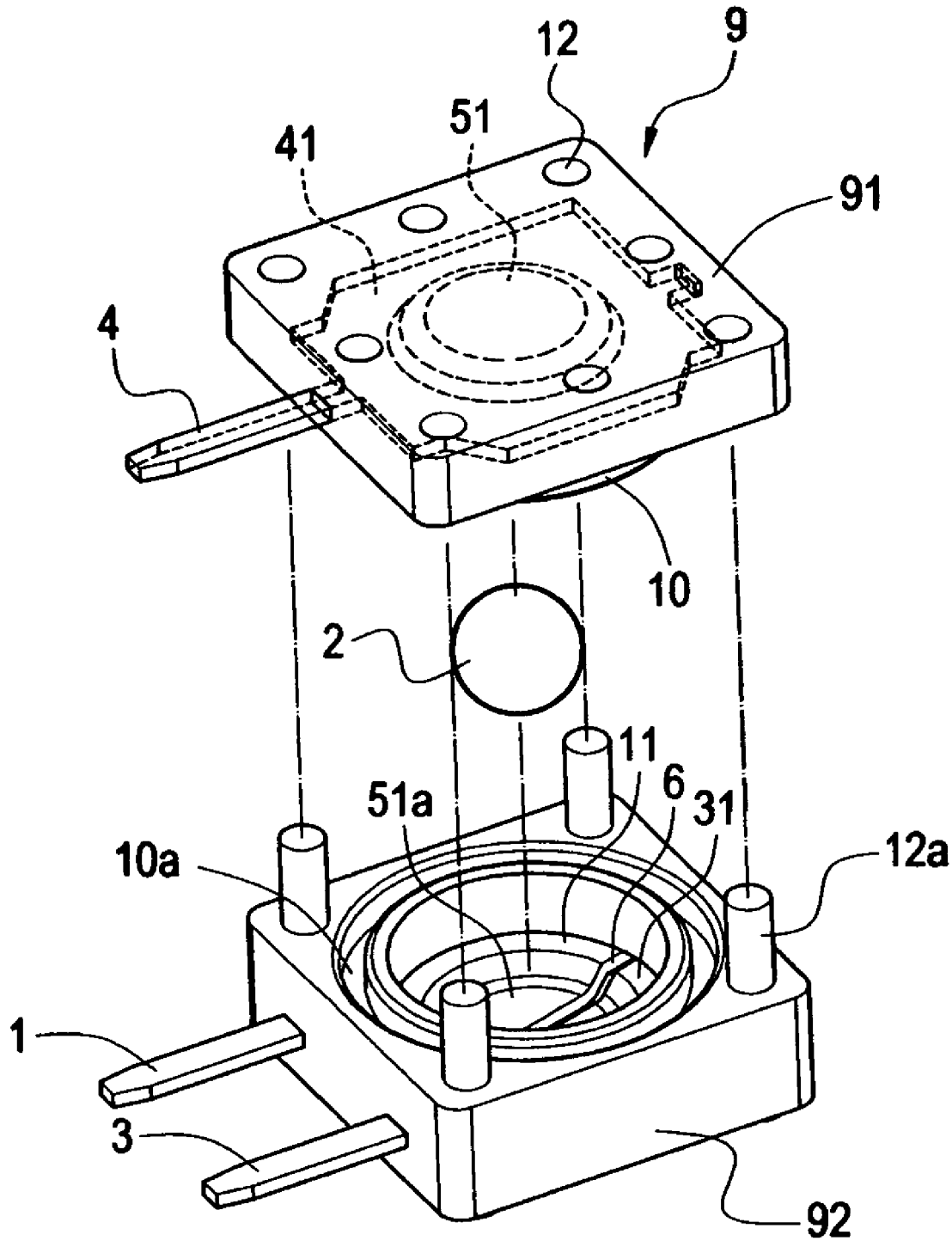
FIG. 4 shows an exploded view of the switch of the present invention.

The annulus chamber 5 includes a dent 51 and 51*a* on two end faces thereof, where distance between the dents 51 and 51*a* is larger than the diameter of the conductive ball 2. The third contact plate 41 is connected integrally with a common terminal 4 outside the annulus chamber 5. The annulus chamber 5 further includes an open groove 6 between the first contact plate 11 and the second contact plate 31. As shown in FIG. 2, the first contact plate 11 is connected integrally with a first terminal 1 outside the annulus chamber 5. The first terminal 1 is electrically connected to a circuit (not shown) of conduction state. The second contact plate is connected integrally with a second terminal 3 outside the annulus chamber 5. The second terminal 3 is electrically connected to a circuit (not shown) of open state.

Figure 5:
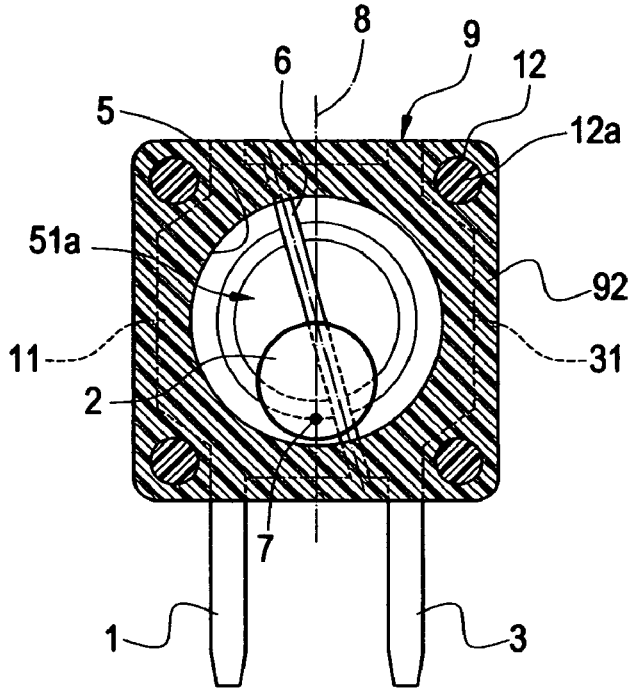
FIG. 5 is a schematic of the switch of the present invention in normal state.
Figure 6:
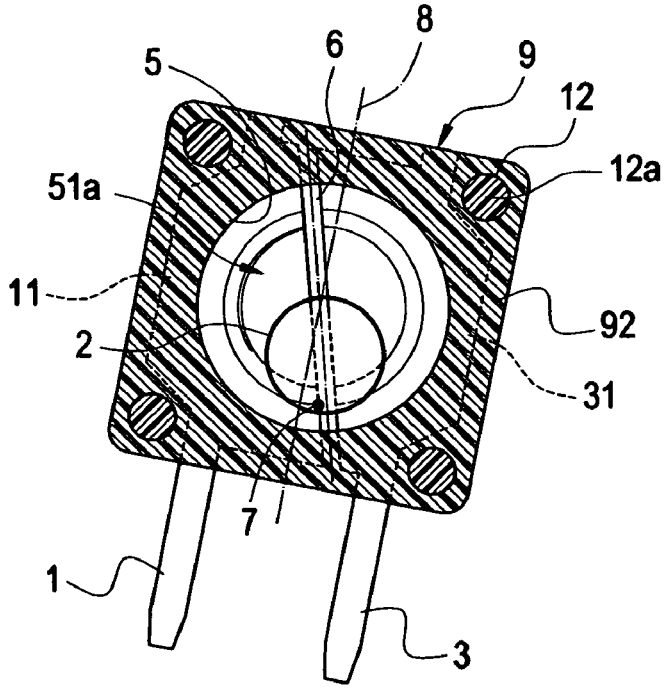
FIG. 6 is a schematic of the switch of the present invention in tilted state.
Figure 7:
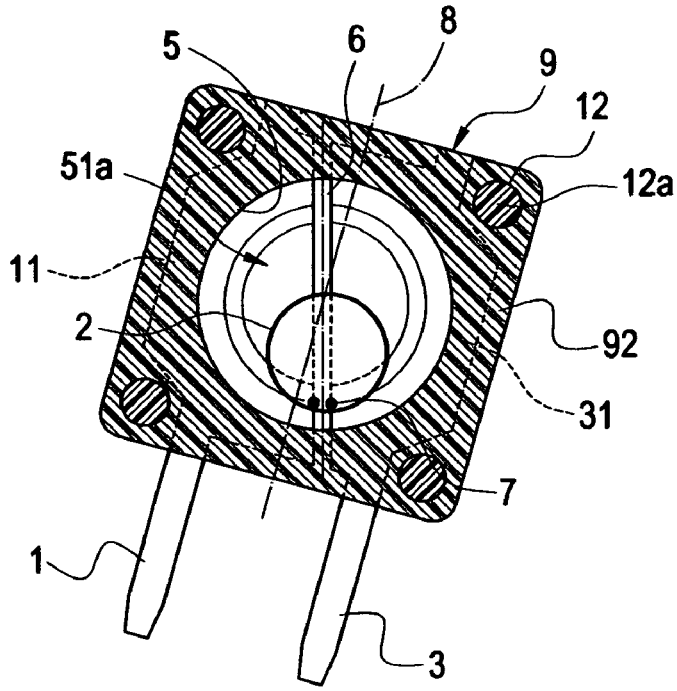
FIG. 7 is a schematic of the switch of the present invention in tilted state, where contact points of end faces are in contact.
Figure 8:
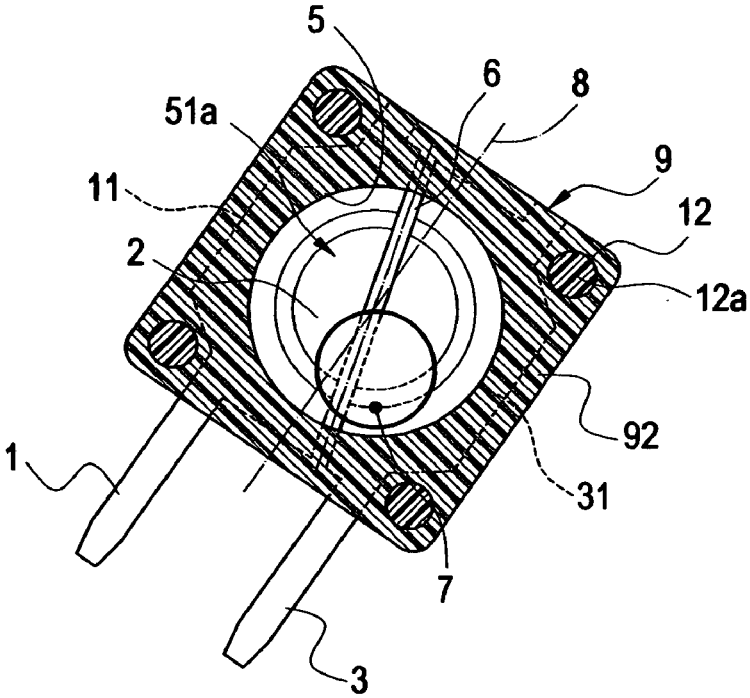
FIG. 8 is a schematic of the switch of the present invention in tilted state, where the switch is turned off.

The open groove 6 has a predetermined angle with a vertical line 8. When the switch is in a normal state, the conductive ball 2 is simultaneously in contact with the first contact plate 11, the second contact plate 31 and the third contact plate 41 on another face of the annulus chamber 5. As shown in FIG. 5, when the switch is in erected position, the switch is conductive and the electrical device (not shown) is in normal operation. As shown in FIG. 6, when the electrical device is rotated a first predetermined angle, the switch is also rotated. At this time, the open groove 6 has an angle such as 10 degrees with respect to the vertical line 8 as shown in FIG. 6. The conductive ball 2 is still simultaneously in contact with the first contact plate 11, the second contact plate 13 and the third contact plate 41. The switch is still at an ON state.

After the electrical device is rotated further to a second predetermined angle such as 20 degrees, the conductive ball 2 is still simultaneously in contact with the first contact plate 11, the second contact plate 13 and the third contact plate 41. The switch is still at the ON state. At this time, it is a critical state. When the switch is rotated back, the situation is back to those shown in FIGS. 5 and 6. When the switch is rotated more in clockwise, the situation is at an OFF state. The conductive ball 2 will not be in contact with the first contact plate 11, while the second contact plate 31 is in contact with the third contact plate 41. At this time, the switch is off and the electrical device is connected to power. As can be seen from FIGS. 5 to 8, the contact point 7 between the conductive ball 2 and the guiding track is at lowest point of the guiding track due to gravity.

Figure 9:
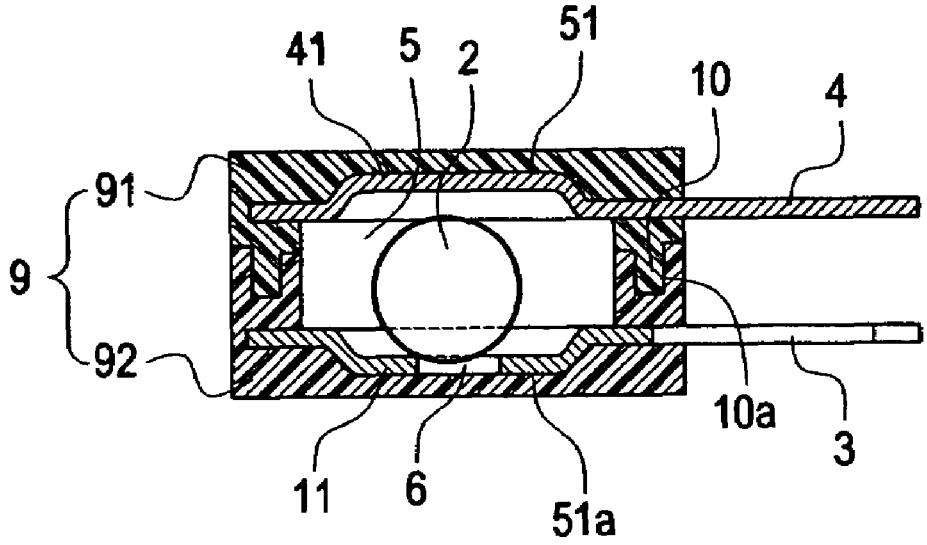
FIG. 9 is a schematic of the switch of the present invention in forward tilted state.
Figure 10:
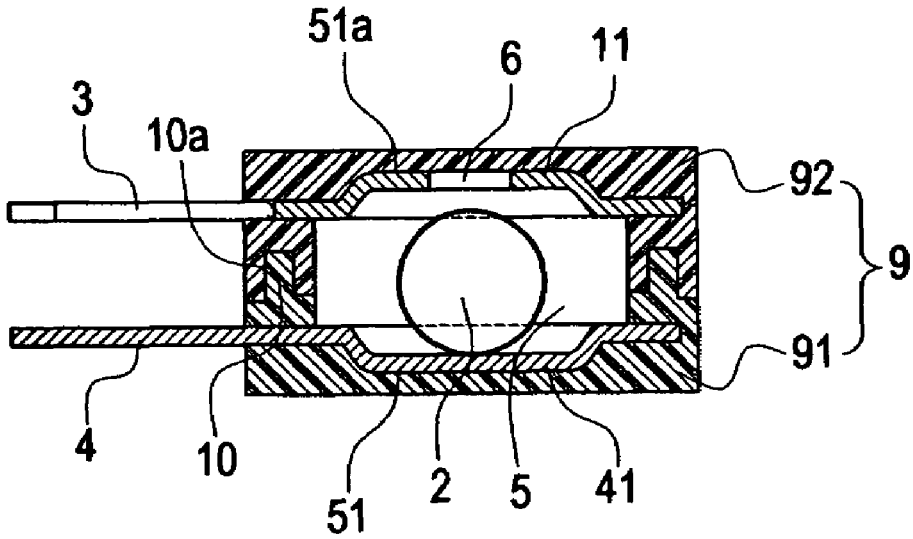
FIG. 10 is a schematic of the switch of the present invention in backward tilted state.

Moreover, the separation between the dents 51 and 51*a* are larger than the diameter of the conductive ball 2. When the electrical device (not shown) is tilted, the switch is tilted forward or backward. The conductive ball 2 is only in contact with the first contact plate 11 and the second contact plate 31. As shown in FIG. 9, when the switch is fallen forward, the conductive ball 2 is not in contact with the third contact plate 41 and the switch is off. As shown in FIG. 10, when the switch is fallen backward, the conductive ball 2 is in contact with the third contact plate 41 and the switch is close.

The dents 51 and 51*a* can be designed as spherical shape or cylinder shape. The switch is off when the switch is tilted with fast response time. To prevent the rush current to melt the contact plate when the contact area between the conductive ball 2 and the contact plates is small, the transition between the dents 51, 51*a* and the guiding rail can be arc shape. The conductive ball 2 has smooth rolling because the contact area is enlarged.

The conductive ball 2 is alternatively conducted during rolling and molten points might occur. Therefore, the surface of the first contact plate 11, the second contact plate 31 and the third contact plate 41 are machined into self-polishing surface. Therefore, the molten points can be removed during rolling process.

Moreover, to enhance the sensitivity of the first contact plate 11, the second contact plate 31 and the third contact plate 41, gold is plated on surfaces of the first contact plate 11, the second contact plate 31 and the third contact plate 41.

The number of the open groove can be more than one. More than one connection way can be provided if the contact plates separated by the open groove 6 are connected to terminals outside the switch. The electrical power can be saved when the electrical device is not rotated with large angle.

The rolling-ball switch of the present invention can be applied to electrical device such as electrical iron, whereby the iron can be powered off when it is tilted to a non-workable angle. Moreover, the rolling-ball switch of the present invention can also be applied to other electrical device, which is liable to tilt or fall, such as electrical fan.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A rolling-ball switch, comprising:

a casing comprising an annulus chamber for guiding rail, the annulus chamber comprising two dents on two end faces thereof, and the casing comprising two racks opposite to each other;

a first terminal arranged on the casing and comprising a first contact plate extended into one end face of the annulus chamber;

a second terminal arranged on the casing and comprising a second contact plate extended into one end face of the annulus chamber;

a common terminal arranged on the casing and comprising a third contact plate extended into one end face of the annulus chamber, wherein the first contact plate and the second contact plate are arranged on one of the rakes and the third contact plate is arranged on the other rake;

a conductive ball arranged in the annulus chamber;

wherein an open groove is defined between the first contact plate and the second contact plate, wherein a distance between the two dents is larger than a diameter of the conductive ball;

when the rolling-ball switch is rotated to a second predetermined angle, the conductive ball is in contact with the first contact plate, the second contact plate and the third contact plate.

2. The rolling-ball switch as in claim 1, wherein a round stage is formed atop one rack and coupling holes are defined around the round stage; wherein a sealing tank is defined on another rack and fits with the round stage, a plurality of coupling posts are provided around the sealing tank and fit in the coupling holes.

3. The rolling-ball switch as in claim 2, wherein the annulus chamber is formed when the round stage is fit into the sealing tank.

4. The rolling-ball switch as in claim 1, wherein the dent of the annulus chamber is spheric shape.

5. The rolling-ball switch as in claim 1, wherein an arc-shaped transition is provided between the dent and the guiding rail.

6. The rolling-ball switch as in claim 1, wherein surfaces of the first contact plate, the second contact plate and the third contact plate are plated with gold.

7. The rolling-ball switch as in claim 1, wherein surface of the conductive ball is plated with gold.

8. The rolling-ball switch as in claim 1, wherein surfaces of the first contact plate, the second contact plate and the third contact plate and the surface of the conductive ball are self-polishing surfaces.

9. The rolling-ball switch as in claim 1, wherein a predetermined angle is between the open groove and a vertical line.

* * * * *

UNITED STATES PATENT AND TRADEMARK OFFICE

CERTIFICATE OF CORRECTION

PATENT NO. : 7,381,916 B2
APPLICATION NO. : 11/413087
DATED : June 3, 2008
INVENTOR(S) : Ping-Tong Wong It is certified that error appears in the above-identified patent and that said Letters Patent is hereby corrected as shown below:

On the title page, item [73]:

Assignee: Comax Electronics (Hul Zhou) Co., Ltd. (Hui Zhou Guang Dong, CN)

should be

Assignee: Comax Electronics (Hui Zhou) Co., Ltd. (Hui Zhou Guang Dong, CN)

"Hul Zhou" was wrong and --Hui Zhou-- is correct.

Signed and Sealed this

Second Day of September, 2008

JON W. DUDAS
*Director of the United States Patent and Trademark Office*